US006254053B1

(12) United States Patent
Taser

(10) Patent No.: US 6,254,053 B1
(45) Date of Patent: Jul. 3, 2001

(54) STICK TOOL HANGER

(75) Inventor: Ahmet Baris Taser, Northfield, IL (US)

(73) Assignee: Fixture Hardware Co., Chicago, IL (US)

( * ) Notice: Subject to any disclaimer, the term of this patent is extended or adjusted under 35 U.S.C. 154(b) by 0 days.

(21) Appl. No.: 09/475,353

(22) Filed: Dec. 30, 1999

(51) Int. Cl.[7] ..... A47K 1/08
(52) U.S. Cl. ..... 248/313; 248/113
(58) Field of Search ..... 248/313, 316.1, 248/316.5, 316.6, 316.2, 113, 229.11, 229.21, 229.14; 211/64, 89.01, 70.6, 59.2

(56) References Cited

U.S. PATENT DOCUMENTS

| | | | | |
|---|---|---|---|---|
| 243,898 | | 7/1881 | Hill | 248/113 |
| 873,762 | | 12/1907 | Lyons | 211/65 |
| 1,380,096 | | 5/1921 | Esnough et al. | 248/113 |
| 1,589,818 | | 6/1926 | Ritter | 248/113 |
| 2,911,173 | | 11/1959 | Deppe | 248/113 |
| 3,556,454 | * | 1/1971 | Huver | 248/317 |
| 4,586,687 | * | 5/1986 | Ziaylek, Jr. | 248/313 |
| 4,723,663 | | 2/1988 | Learn | 211/59.2 |
| 4,821,990 | * | 4/1989 | Porter et al. | 248/316.5 |
| 4,909,467 | | 3/1990 | Shan-Pao | 248/312 |
| 5,102,177 | | 4/1992 | Dreisig et al. | 294/106 |
| 5,116,003 | | 5/1992 | Gerhardt | 248/312 |
| 5,322,256 | | 6/1994 | Kanwischer | 248/312 |
| 5,354,029 | * | 10/1994 | Ziaylek, Jr. et al. | 248/313 |
| 5,388,709 | | 2/1995 | Adams | 211/70.6 |
| 5,687,857 | | 11/1997 | Friedman | 211/89 |
| 5,839,589 | | 11/1998 | Hillard | 211/70.6 |

* cited by examiner

*Primary Examiner*—Ramon O. Ramirez
*Assistant Examiner*—Gwendolyn Baxter
(74) *Attorney, Agent, or Firm*—George H. Gerstman; Seyfarth Shaw

(57) ABSTRACT

A hanger is provided with two pairs of elongate arms supported by a base and two article gripping members attached to the arms. The hanger is suited for holding stick tools, such as gas or electric lawn trimmers and lawn edgers, in a vertical position.

10 Claims, 3 Drawing Sheets

STICK TOOL HANGER

FIELD OF THE INVENTION

The present invention concerns a novel hanger capable of displaying stick tools, such as lawn trimmers or lawn edgers and the like, in a vertical position.

BACKGROUND OF THE INVENTION

Certain stick tools, especially those with gas engines or electric motors, are particularly difficult to display in an upright or vertical position. They are generally designed to be of light or moderate weight so that they may be comfortably carried and used by a single person. However, the engine or motor is relatively heavy compared to the rest of the components and is generally placed at or near one end of the tool. Because of this, the center of gravity of the tool is widely displaced from the center of the device lengthwise. With the center of gravity so far away from the mid-point of the length, these devices have a great tendency to tip and it is difficult to hold these devices in an upright vertical position.

Prior art solutions to these problems, especially for displaying such devices at a retail sales establishment, have not been entirely satisfactory. It is generally preferred to display these devices vertically. Prior art hangers used to display these devices vertically had many deficiencies. In order to hold the device safely, in many instances it was necessary to attach the tool to the bracket in a way it could not be easily detached. This made removal for purchase and replacement of displayed devices difficult. And, prior art devices which held the devices for easy removal were often not strong or secure enough. Many retailers chose to display these devices on horizontal racks or brackets but, if a customer tried to pick one up, it would have a tendency to rotate very quickly and might be dropped damaging the device and injuring the customer.

The present invention overcomes these deficiencies and satisfies the existing need for a stick tool hanger which is safe and convenient to use for retail display of such devices as lawn trimmers and lawn edgers.

It is, therefore, an object of the present invention to provide a stick tool hanger which is sturdier in construction, safer and more convenient than prior art hangers.

Another object is to provide a device which will hold a stick tool vertically and into which a tool may be easily placed and removed.

Other objects and advantages of the present invention will become apparent as the description proceeds.

SUMMARY OF THE INVENTION

In accordance with the present invention, a hanger is provided with two pairs of elongate arms supported by a base and two article gripping members attached to the arms. The hanger is designed so that when upward or pushing pressure is applied to the ends of the arms opposite the base the gripping members move apart so that an article to be held can be placed between them. The gripping members are urged together by gravity so that an article placed between them is held in a substantially vertical position.

In the illustrative embodiment, the base is a box-like structure equipped with appropriately curved bars for attachment to a peg-board or with screw or bolt holes so that it can be mounted on a wall. The arms are attached to the base so they can pivot up and down. The arms cross over the other arm in the pair. A separation limiter in the form of a ring is placed on at least one pair of arms. The ring limits the separation of the arms and the distance the arms and the gripping members can be raised.

The gripping members are attached to the end of the straight portion of the arms in a manner that allows the gripping members to remain vertical while the arms move upward. The gripping members are curved in order to receive and hold the generally circular shaft of stick tools. Pads made of rubber or the like are placed inside the gripping member in order to securely hold the tool and prevent marring of the tool's surface. One or more stops can be positioned on the gripping members to prevent a tool from being pushed too far into the hanger and to ensure the tool is properly seated the gripping members.

The arms are curved inwardly towards the other arm in the pair beginning immediately distally of the gripping members and then curved outwardly. The two arms of each pair thus create "V" shaped receivers.

A stick tool can be placed in the hanger by pushing its shaft into the "V" shaped receiver. The pushing force will cause the arms to be raised and the gripping members to move apart. The tool may then be positioned between the gripping members. The arms will lower and the gripping members will converge around and engage the shaft of the stick tool under the force of gravity. The tool will then be held in a vertical position and the weight of the tool itself will contribute to the force holding the tool between the gripping members.

In order to remove the tool, the stick tool can be lifted. As it is lifted, the arms of the holder will be raised and the gripping members will separate. The stick tool can then be pulled out of the holder.

DETAILED DESCRIPTION OF THE ILLUSTRATIVE EMBODIMENTS

Figure 1:
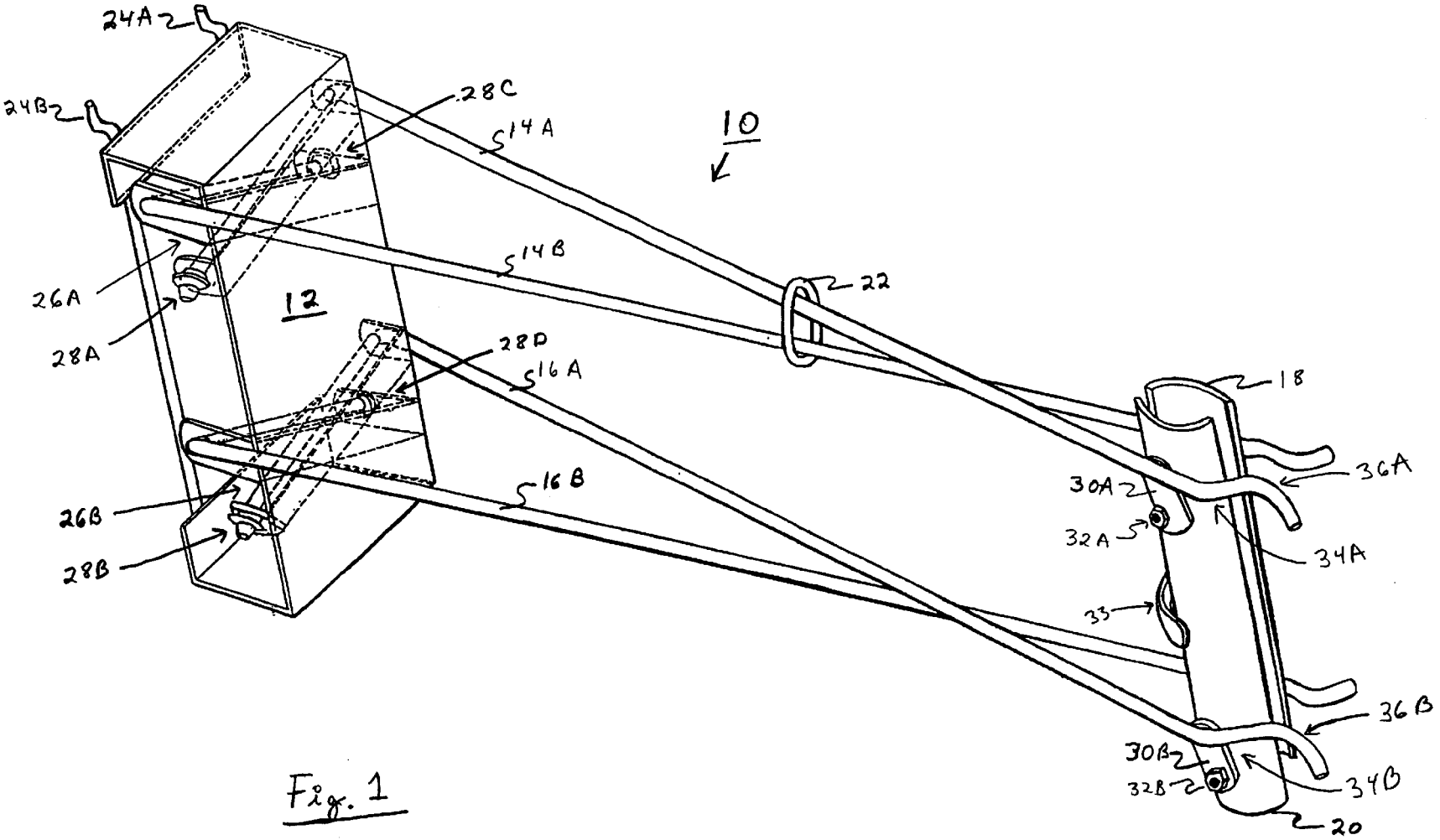
FIG. 1 is a perspective view of a hanger constructed in accordance with the principles of the present invention.

Referring to the drawings, a stick tool hanger 10 is shown which comprises a base 12, two pairs of arms 14A, 14B and 16A, 16B and two gripping members 18, 20. A separation limiter in the form of ring 22 is shown on the upper pair of arms 14A, 14B.

The base 12 is generally attached to a flat vertical surface such as a wall or a peg board. In the illustrative embodiment shown, two appropriately bent wires 24A, 24B are mounted on the rear of the base 12 so that the hanger 10 may quickly and conveniently be attached to a peg board. In a preferred embodiment not shown in the drawing, a separate piece may be provided to be placed below the base 12 on the peg board or other supporting surface to provide additional support and stability. Of course, the base 12 may alternatively be prepared with screw or bolt holes or the like so that it may be attached to the supporting surface by alternative means. And, in certain preferred embodiments, the back of base 12 may be a continuous closed surface or have mounting plates or other mounting hardware attached.

In the embodiment shown in the drawing, the sides of the base 12 are open and the arms 14A, 14B, 16A, 16B pass through the open sides. Of course, the sides of base 12 could be closed as long as appropriate slots or holes are provided for the arms. In order to support the arms 14A, 14B, 16A, 16B two "X"shaped brackets 26A, 26B are mounted to the back of the front face of the base 12. The brackets 26A, 26B are configured so that appropriately bent ends of the arms 14A, 14B, 16A, 16B each pass through a hole in an upper tab of one of the brackets 26A, 26B and through a hole in a lower tab of one of the brackets 26A, 26B. A cap or keeper 28A, 28B, 28C, 28D is attached to the very end of each of the arms 14A, 14B, 16A, 16B. The proximal ends of the arms 14A, 14B, 16A, 16B are bent inward and downward and one arm of each pair is slightly longer than the other arm in the pair and the set of tabs on the brackets 26A, 26B holding the hanger arm are slightly longer than the other set of tabs on the same bracket so that the arms 14A, 14B, 16A, 16B can be crossed over each other behind the front wall of the base 12. The arms 14A, 14B, 16A, 16B are mounted in the brackets 26A, 26B so that they may pivot upward.

The arms 14A, 14B, 16A, 16B are bent inwardly and each pair of arms crosses between the base 12 and the gripping members 18, 20. A tab (only two of four tabs 30A and 30B are shown in FIG. 1) is placed at the distal end of the straight portion of each arm by, for example, welding. These tabs 30A, 30B are provided with holes to accept dowels, bolts or other attachment means in order to affix the gripping means 18, 20 to the arms 14A, 14B, 16A, 16B. In the illustrative embodiment, threaded washer nuts 32A, 32B (only two of four shown) are placed on threaded dowels welded to the outside surface of the gripping members 18, 20 and passed through holes in the tabs 30A, 30B. The washer nuts are not tightened completely so that the gripping members 18, 20 may pivot with respect to the arms 14A, 14B, 16A, 16B. Each gripping member is attached to one of the upper arms and one of the lower arms in order to hold vertically.

The gripping members 18, 20 are curved in order to accept the circular shaft of a stick tool. One or more curved stops 33 are placed on one or both gripping members 18, 20 to prevent a tool from being pushed too far into the hanger. The inner surfaces of the gripping members 18, 20 are provided with rubber pads or the like to securely hold a tool and to prevent marring of the tool's surface.

As the arms continue distally, they are bent first inwardly and then outwardly in order to create "V" shaped receivers in each pair of arms. In the illustrative embodiment shown in the drawings, the first set of these bends in the arms 14A, 14B, 16A, 16B is made just distal at the points 34A, 34B and the second set of these bends is made at the points 36A, 36B.

Figure 2:
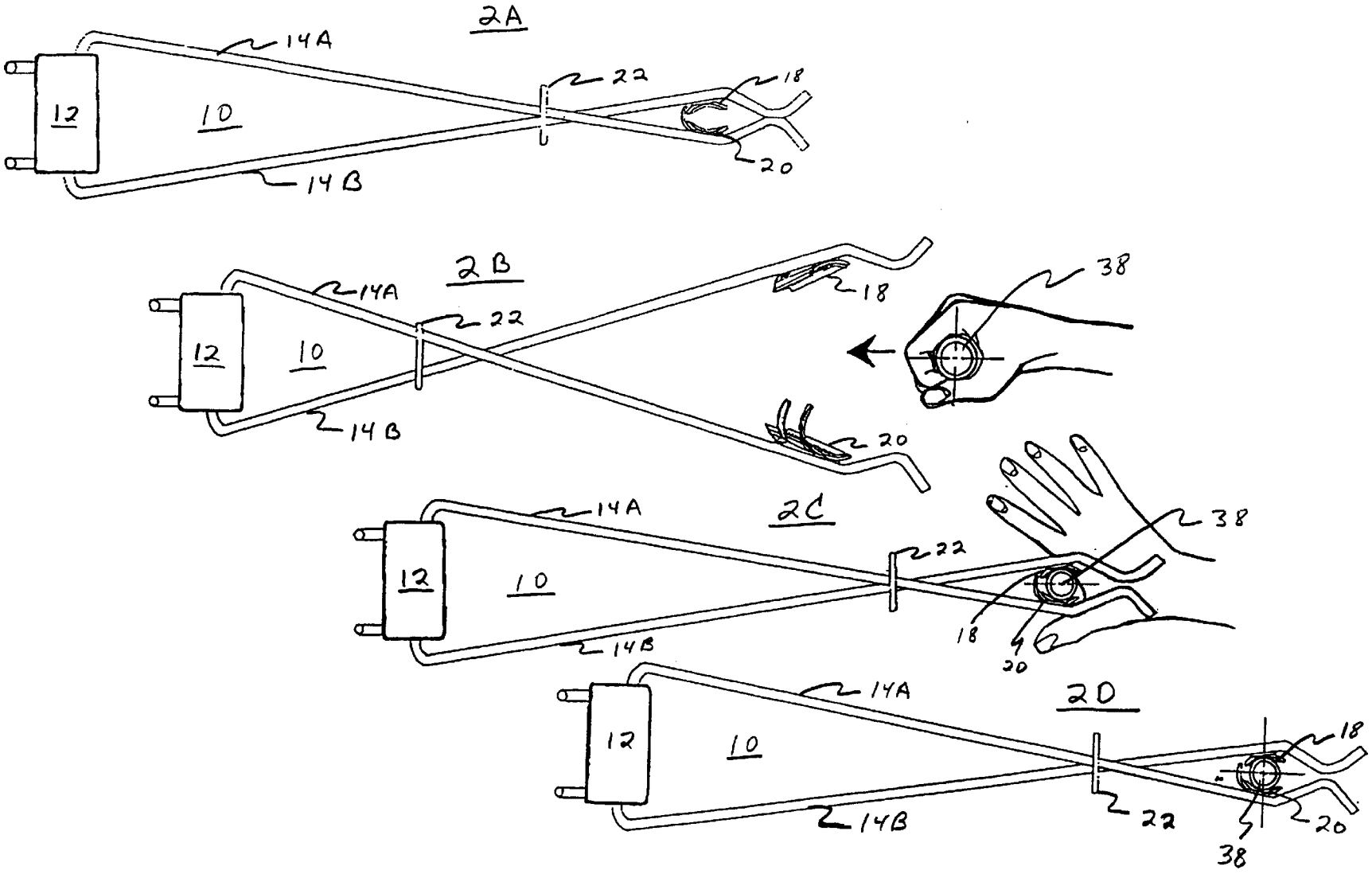
FIG. 2 comprised of 2A, 2B, 2C, 2D is a top view illustrating placement of a stick tool into the hanger.
Figure 3:
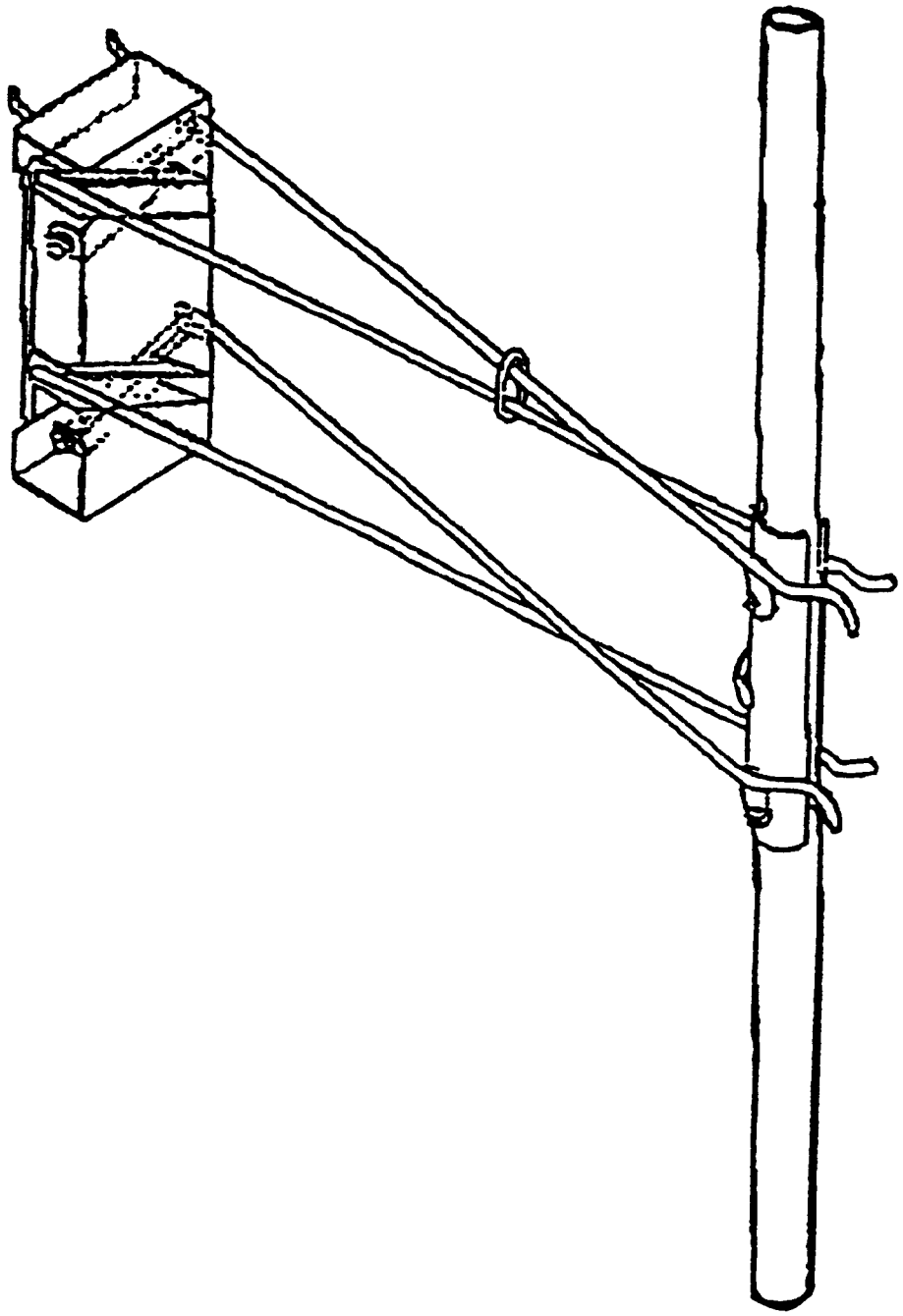
FIG. 3 is a perspective view of the hanger holding a stick tool.

The manner in which a stick tool is placed in the hanger 10 is shown in FIG. 2. In FIG. 2A, the hanger is shown empty from a top perspective. In FIG. 2B, the hanger 10 has been opened by either raising the arms or pushing the tool shaft 38 against the distal ends of the arms. In FIG. 2C, the tool shaft 38 has been placed between the gripping members 18, 20 and is being released. Gravity will urge the arms down and the gripping members together to clamp the tool and hold it firmly. In FIG. 2D, the tool shaft 38 is shown being held in the hanger 10. FIG. 3 shows a different perspective of the tool shaft being held in the hanger 10.

The hanger is preferably made of metal such as steel. For example, the base may be made of 14 gauge steel, the arms may be made of 5/16 inch wire and the gripping members may be made of 16 gauge steel. Of course, other materials or sizes may be used and may be chosen based upon the intended use of the hanger. For example, lighter materials may be used if the hanger will be used for only hanging light weight tools like small brooms and heavier materials should be used if the hanger may be used for hanging very heavy tools like gas-powered lawn trimmers or water-soaked mops.

Although an illustrative embodiment of the invention has been shown and described, it is to be understood that various modifications and substitutions may be made by those skilled in the art without departing from the novel spirit and scope of the present invention.

What is claimed is:

1. A hanger comprising:

a base suitable for attachment to a substantially flat and vertical surface;

an upper pair of elongate arms attached to said base;

a lower pair of elongate arms attached to said base;

a first article gripping member attached to one of said upper arms and to one of said lower arms, and a second article gripping member attached to the other of said upper arms and to the other of said lower arms;

said first and second article gripping members being positioned on said arms at a location spaced from the ends of said upper and lower arms, the outer ends of said pairs of upper and lower arms defining V-shaped receivers to facilitate insertion of a stick tool between the pairs of arms;

wherein an upward pushing force applied to the arms at the ends opposite the base causes the gripping members to rotate and move apart so that an article to be held can be placed between them, and wherein gravity downwardly urges said gripping members together, so that an article placed between them will be held in a substantially vertical position.

2. The hanger of claim 1 further comprising a separation limiter on at least one of said pair of arms.

3. The hanger of claim 1 in which said first and second curved gripping members each have a major dimension which is transverse to the longitudinal axes of the respective arms of said upper and lower pairs.

4. The hanger of claim 1 in which one arm of each pair of arms is slightly longer than the other arm in the pair to permit the arms to cross each other and end at equal positions.

5. A hanger comprising:

a base suitable for attachment to a substantially flat and vertical surface;

an upper pair of arms with distal ends pivotally attached to said base and which cross at a point between said base and the distal ends of said arms;

a lower pair of arms with distal ends pivotally attached to said base and which cross at a point between said base and the distal ends of said arms;

a separation limiter on at least one pair of said arms;

a first curved gripping member pivotally attached to one of said upper arms and one of said lower arms between where said pair of arms cross over and the distal ends of said arms;

a second curved gripping member pivotally attached to one of said upper arms and one of said lower arms between where said pairs of arms cross over the distal ends of said arms;

said first and second curved gripping members being positioned on said arms at a location spaced from the ends of said upper and lower arms, the outer ends of said pairs of upper and lower arms defining V-shaped receivers to facilitate insertion of a stick tool between the pairs of arms; and wherein said gripping members move apart when raised and are urged downwardly and towards each other by gravity.

6. The hanger of claim 5 in which said first and second curved gripping members each have a major dimension which is transverse to the longitudinal axes of the respective arms of said upper and lower pairs.

7. The hanger of claim 5 in which one arm of each pair of arms is slightly longer than the other arm in the pair to permit the arms to cross each other and end at equal positions.

8. A hanger comprising:

a base suitable for attachment to a substantially flat and vertical surface;

an upper pair of elongate arms attached to said base;

a lower pair of elongate arms attached to said base;

a first article gripping member attached to one of said upper arms and to one of said lower arms and a second article gripper member attached to the other of said upper arms and to the other of said lower arms, said arms each comprising an inner end that is bent inwardly and vertically angled to the horizontal, said inner ends being rotatably attached to said base, said first and second article gripping members each having a major dimension that is transverse to the longitudinal dimension of said elongate arms of the upper and lower pair;

whereby an upward pushing force applied to the arms at the ends opposite the base causes the gripping members to rotate upwardly and move apart so that an article to be held can be placed between them, and whereby gravity urges said gripping members downwardly and together so that an article placed between them will be held in a substantially vertical position.

9. The hanger of claim 8 in which said first and second article gripping members are attached to said upper and lower arms at positions spaced from the outer ends thereof, the outer ends of said upper and lower arms defining together V-shaped receivers in each pair of arms, to facilitate the insertion of stick-like objects between said arms for hanging.

10. The hanger of claim 8 in which one arm of each pair of arms is slightly longer than the other arm in the pair to permit the arms to cross each other and end at equal positions.

* * * * *